United States Patent [19]

Winter

[11] 3,930,616

[45] Jan. 6, 1976

[54] WATER BLAST APPARATUS

[76] Inventor: Frank N. Winter, 1450 Wainwright, San Leandro, Calif. 94577

[22] Filed: Oct. 7, 1974

[21] Appl. No.: 512,419

[52] U.S. Cl. ..... 239/525; 239/101; 239/270; 239/569; 239/579

[51] Int. Cl.[2] .... B05B 7/02; B05B 1/08; B05B 1/30; A62C 23/06

[58] Field of Search ..... 239/525, 577, 569, 579, 239/124, 125, 101, 270; 251/111, 114, 112, 113; 128/380

[56] References Cited

UNITED STATES PATENTS

| | | | |
|---|---|---|---|
| 188,909 | 3/1877 | Howard | 239/525 |
| 2,090,277 | 8/1937 | Williams | 239/569 |
| 2,271,715 | 2/1942 | Saffell et al. | 239/569 |
| 2,457,993 | 1/1949 | Fletcher et al. | 239/579 |
| 2,813,529 | 11/1957 | Iske | 239/526 |
| 3,520,477 | 7/1970 | Cooley | 239/101 |
| 3,711,020 | 1/1973 | Zelna | 239/101 |

FOREIGN PATENTS OR APPLICATIONS

| | | | |
|---|---|---|---|
| 7,668 | 5/1888 | United Kingdom | 239/270 |

*Primary Examiner*—Lloyd L. King
*Attorney, Agent, or Firm*—Warren, Chickering & Grunewald

[57] ABSTRACT

Apparatus including the combination of a nozzle adapted for connection to a source of fluid under pressure and having a port for discharging a jet fluid axially of the port and a wall mounted in spaced relation to the port and generally across its axis and having an opening dimensioned for passage therethrough of the jet when the port and wall opening are in registration, and wherein the wall and nozzle are mounted for relative displacement for moving the port and opening into and out of registration; and manually engageable means for effecting such relative displacement. Additionally a housing is provided around the nozzle to form a relatively enlarged, reduced pressure, fluid collection chamber for fluid deflected by the wall in the misaligned "shutoff" position of the device. A discharge outlet is provided for the collection chamber and fluid discharged in the shutoff position is optionally used for cleaning of the operator's face shield and for confunctioning with the burner-pump control circuit of a hot water or steam blast system.

13 Claims, 10 Drawing Figures

WATER BLAST APPARATUS

BACKGROUND OF THE INVENTION

1. Field of Invention

The invention relates to water blast systems of the type using a small volume, high pressure, water jet typically in the range of up to about 10,000 psi and a water volume of about 4 to 6 gallons per minute, the jet being formed by passing the high pressure water through a small opening which may be round for forming a straight water jet or slotted for forming a fan jet.

2. Description of Prior Art

Water blast systems of the character described have in recent years become widely used for cutting, stripping and cleansing operations such as removal of paint, corrosion, rust, scale as required in preparation for painting or for boiler coil cleaning and the like; cutting of green concrete; stripping marine growth and oxidized paint from ships' hulls; removing polymers from heat exchangers and residues from evaporating tubes in chemical plants; and etc. The water blast system may be used in many instances in place of dry sand blasting or sand or other abrasive material may be introduced into the water jet.

Water blast systems customarily use a high pressure positive displacement pump driven by an internal combustion engine or electric motor, the pump being connected by a high pressure hose to a manually directed nozzle usually some distance away from the pump and engine. Some form of remote control system is required for the operator, at the nozzle, to control the operation of the power source, i.e., the rpm of the pump drive. Such remote controlled operation has certain disadvantages. It is normally possible to operate only one nozzle from one fluid pressure source since the source must be at all times under the control of an individual operator to meet his individual demands. Also there is danger of failure of the control caused by shorting or open circuit in an electric line or by bending or kinking of a pneumatic or hydraulic control hose, any of which may cause an increase in the pump output and correspondingly an increase in line pressure without prior notice to the operator.

The foregoing controls also involve a certain time delay, usually several seconds from the time of shutoff at the nozzle to actual significant reduction in pressure. The control systems are inherently cumbersome and bulky in the requirement of the additional cables, conduits and the like, as well as the switches, valves and other controls connected thereto.

SUMMARY OF INVENTION

By comparison to the foregoing, the device of the present invention involves no auxiliary electric, pneumatic or hydraulic control lines or devices in the blast control system. The on-off control for the nozzle is purely mechanical and is located directly at the nozzle under the direct and instant control of the operator. A multiplicity of nozzle units may be simultaneously used with a single pump-power source, with the source delivering its full rated capacity, and the individual operator controlling the water blast at each of the several nozzles.

An object of the present invention is to provide a water blast apparatus of the character described which is compact, light in weight, easily handled, directed, manipulated and easily and precisely controlled by the operator and which will automatically move to its shut-off position upon setting down of the device.

Another object of the present invention is to provide a water blast apparatus of the character above which will provide improved safety and dependability in its operation and which in the elimination of many heretofore required parts, will provide a long life of trouble-free operation.

A further object of the present invention is to provide a water blast apparatus of the character described which may use either high pressure cold water, hot water or steam, and which will make an economical use of the fluid in that the latter may if desired be recirculated to the source in the off position of the device.

Still another object of the present invention is to provide a water blast apparatus of the character above in which blast fluid is optionally used in the off position of the device for cleaning the operator's face shield or controlling the burner-pump circuit of a hot water or steam blast system.

Yet a further object of the present invention is to provide a water blast apparatus of the character described which may be used as a straight water or steam jet, or with entrained sand or other abrasive particles for wet sand blasting.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims. Referring to said drawings:

DETAILED DESCRIPTION OF INVENTION

Figure 1:
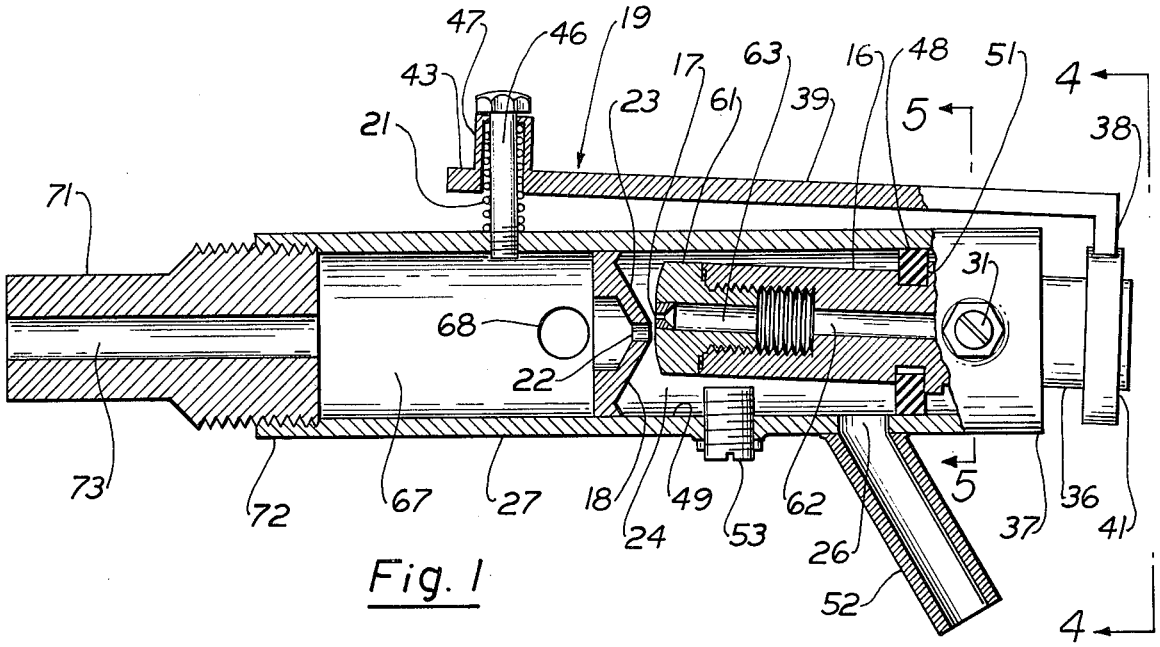
FIG. 1 is a cross-sectional view, partly in elevation, of a water blast apparatus constructed in accordance with the present invention and shown with the parts in shut-off position.
Figure 2:
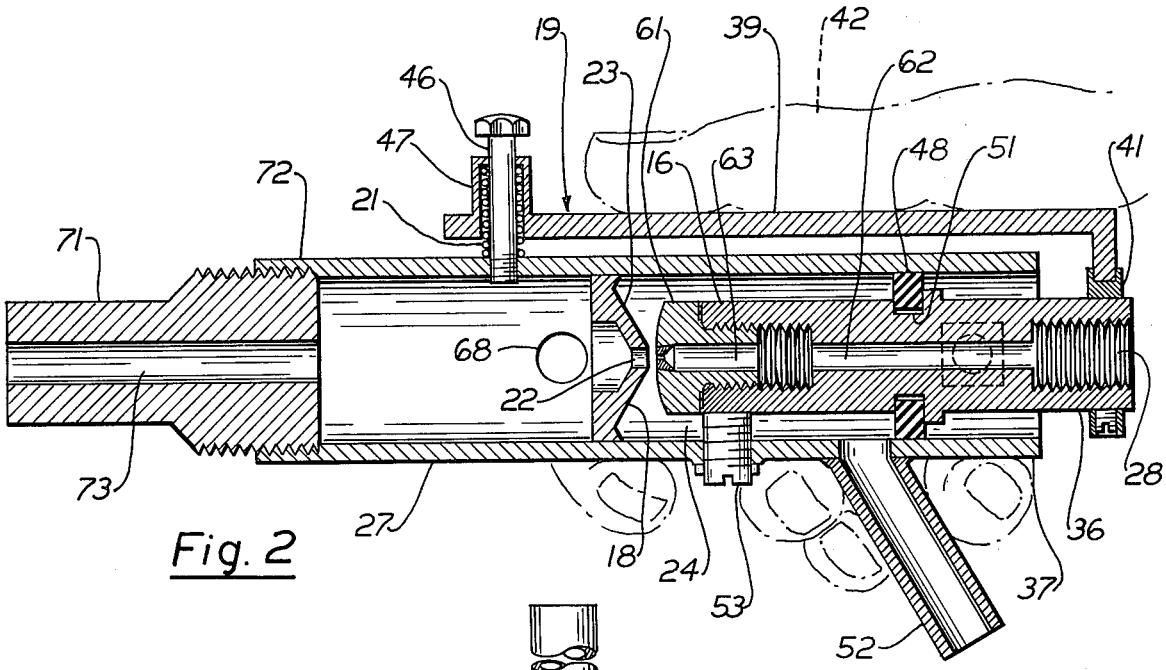
FIG. 2 is a longitudinal sectional view of the device illustrated in FIG. 1 but with the parts moved to operating position.

The water blast apparatus of the present invention comprises briefly a nozzle 16 adapted for connection to a source of fluid under pressure and having a port 17 for discharging a jet of fluid axially of the port; a wall 18 mounted for relative displacement with respect to nozzle 16 and providing operable and inoperable positions with the wall spaced from and intersecting the axis of port 17 respectively, compare FIGS. 1 and 2; and manually engageable means 19 connected to the wall and nozzle for effecting such relative displacement. Preferably spring means 21 is used to bias a nozzle and wall to inoperative position, as seen in FIG. 1, and means 19 is engageable for displacement of the parts to operable position, as seen in FIG. 2, against the resistance of spring means 21.

As will be seen in the drawings, wall 18 is mounted in spaced relation to the port downstream from and generally across the port axis, and preferably, and as here shown is formed with an opening 22 dimensioned for passage therethrough of the jet issuing from port 17 in the aligned registration of the port and opening in operable position as seen in FIG. 2. As a further feature of the present construction, wall 18 is provided with a surface 23 confronting port 17 of frusto-conical form symmetrical to the port axis, and is arranged with opening 22 at its apex and with the sloping surface 23 diverging from the jet axis in a direction away from port 17. Accordingly in the misaligned, shutoff position of the parts, the jet issuing from port 17 will impinge on the sloping surface 23 of the wall.

Figure 3:
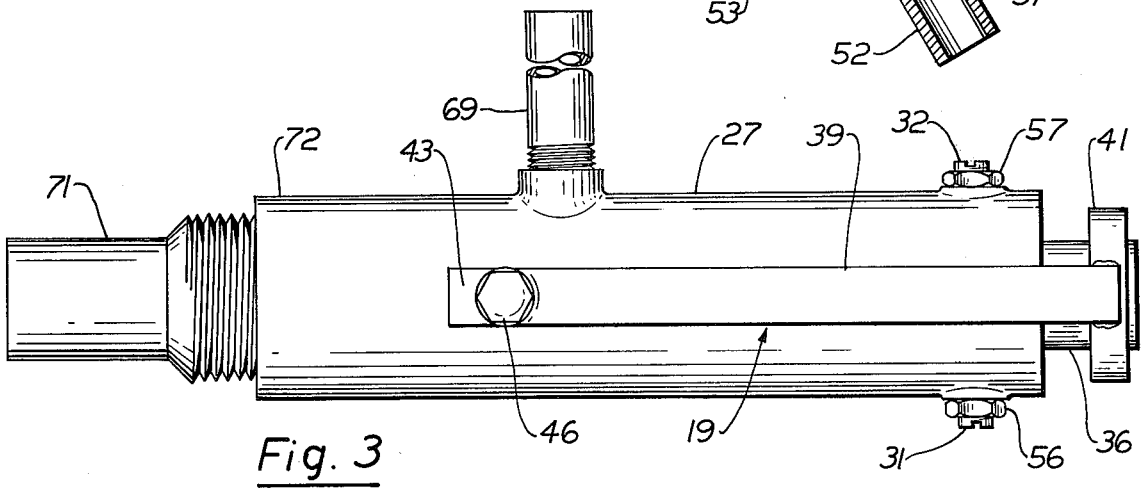
FIG. 3 is a plan view of the device.
Figure 4:
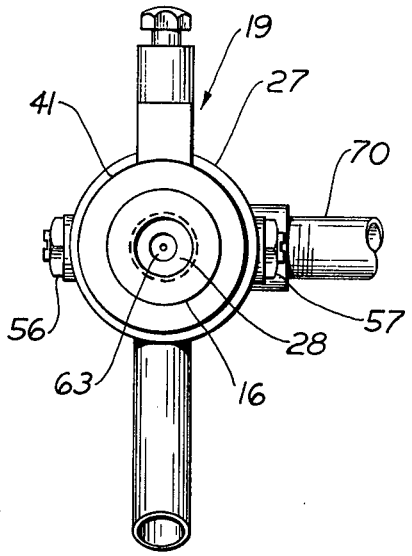
FIG. 4 is an end view of the device, as suggested by line 4—4 of FIG. 1.
Figure 5:
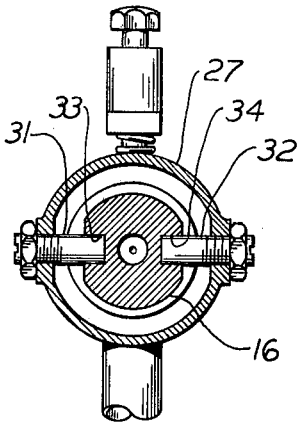
FIG. 5 is a cross-sectional view of the device taken substantially on the plane of line 5—5 of FIG. 1.

As a further and important feature of the present construction, means is provided on cofunctioning relation with wall 18 and nozzle 16 for providing a relatively enlarged, low pressure (essentially atmospheric) chamber 24 for fluid deflected by wall 18 in the shutoff position of the parts, and for providing a discharge outlet 26 for the chamber. Such means here comprises a housing 27 surrounding nozzle 16 in spaced relationship with wall 18 being mounted across the interior of the housing in spaced relation to nozzle port 17 at its downstream side. As will be seen from FIGS. 1 and 2, nozzle 16 is of elongated form having port 17 at its interior end and an inlet passage 28 at its opposite exterior end, and the mounting means for the nozzle interiorly of the casing provides for relative swivel motion between the nozzle and the housing for providing the operable and inoperable or shutoff positions of the parts. Such mounting means here comprises a pair of coaxial pivot pins 31 and 32, see FIGS. 3 and 5, carried diametrically by housing 27 and extending into diametrically aligned, coaxial recesses 33 and 34 formed in the body of nozzle member 16 intermediate its ends, see FIG. 5. Preferably, the exterior end 36 of nozzle member 16 projects from the adjacent rear end 37 of housing 27 for attachment of one end 38 of a lever 39 here forming the manually engageable means 19. Lever end 38 is here secured to nozzle end 36 by a surrounding collar 41 and the lever is bent at right angles from end 38 so as to extend into spaced confronting position with respect to housing 27 for convenient manual gripping conjointly with the housing, as depicted by the hand 42 in FIG. 2. As will be apparent from FIGS. 1 and 2, depressing of lever 39 in the direction of housing 27 will cause the housing and nozzle to swing about pivot pins 31 and 32 into aligned position of the ports as seen in FIG. 2. Spring 21 is here interposed between the free end 43 of lever 39 and housing 27 to resist movement of the parts to axially aligned position and to automatically return the parts to a misaligned, shutoff position, as seen in FIG. 1, upon manual release of lever 19. In the present structure lever end 49 is retained for reciprocation on a guide post 46 fastened to and projecting perpendicularly from the exterior surface of housing 27. Additionally lever 19 is provided with a spring chamber 47 for housing one end of spring 21 which is here of helical form surrounding post 46 and having its opposite end supported on housing 27. Accordingly, movement of lever 19 toward housing 27 to effect alignment of the nozzle port and deflector wall opening will be resiliently resisted by spring 21, and the latter will automatically effect the return of the parts to the misaligned, shutoff position upon manual release of lever 19 as will occur when the operator lays down the blast gun.

Chamber 24 is preferably enclosed by the inclusion of a flexible sealing gasket of elastomeric material mounted in and sealing off the annular chamber 24 surrounding nozzle member 16 and the interior surface 49 of housing 27. As here shown, gasket 48 is retained in an annular ring groove 51 formed in nozzle member 16 and has its outer periphery compressed against the interior surface 49 of housing 27. A leadoff pipe 52 may be connected to chamber outlet 26 for discharge of fluid gathered in chamber 24 in the shutoff position of the parts.

As another feature of the present construction, very precise means is provided for obtaining axial alignment and registration of port 17 and opening 22. As here shown a set screw 53 is threaded through the wall of housing 27 along an axis perpendicular to the axis of pivot pins 31 and 32 and is set to contact nozzle 16 in its aligned position as seen in FIG. 2. At the same time, pins 31 and 32 are threaded into housing 27 for individual adjustment along their length to thus adjustably position nozzle 16 transversely of the interior of chamber 24 on an axis perpendicular to the adjustment provided by said screw 53. Lock nuts 56 and 57 are here threaded onto the outer ends of pins 31 and 32 to bear against housing 27 to lock the pins in adjusted position.

Various forms of jets, straight pencil or fan, may be obtained by proper shaping of port 17. The latter is here contained in a separate nozzle tip 61 which may be threaded into nozzle body 16 for this purpose. Various nozzle tips containing various shaped ports are commercially available in a conventional nut-type member as here illustrated and which may be threaded into the interior end of nozzle member 16. These nozzle tips or holders are usually fitted with a special aperture piece having the actual nozzle opening. Typically the latter will have a diameter of about 0.0039 inches, depending on pressure and volume requirements. The main body of nozzle member 16 is here formed with a much larger axial bore 62 connecting inlet passage 28 with a central bore 63 in nozzle tip 61. The nozzle size is not critical. Various sizes are used depending upon fluid pressures and volumes available and required. Normally the available fluid volume is controlled by controlling the rpm of the pump drive. The usual pressure range for the present apparatus is up to about 10,000 pounds per square inch and the usual jet volume is up to about 6 gallons per minute. As an important feature of the present invention, this very high pressure and intense water jet is completely tamed and controlled in the off position of the device by the direction of the jet onto the conical deflector face 23. It has been found that wall 18 will serve to deflect water into chamber 24, immediately dissipating or dulling the pressure, and will withstand the impinging action of the jet over an indefinitely long period of time without undue wear or deterioration. Additionally, it has been found that the angularity of inclined face 23 aids in the movement of the parts to shutoff position so that the parts will automatically stay in shutoff position until the handle is deliberately displaced by the operator, thus providing an inherent fail-safe structure. Due to the relatively small volume of the jet, the accumulation of fluid within chamber 24 in the shutoff position is readily handled by the size of the chamber and outlet opening 26 without any problem of congestion, undue pressure buildup or force reaction. Thus the operator has only to lay down the gun to have it move automatically and with complete safety into its shutoff position. Housing 27 may be readily built to withstand many times the operating pressure to which the device is subjected so that the operator in handling the device is always protected against any accidental overrunning of the applied pressure which may occur on malfunctioning of the control circuit permitting a runaway operation of the pump driving motor. Preferably, the housing nozzle and wall are made of stainless steel to resist rust and corrosion.

The water blast apparatus of the present invention may be optionally used with or without the addition of sand or other materials to the blast jet. Where such materials are to introduced into the jet, housing 27 is extended forwardly of wall 18 so as to define a venturi chamber 67 having an inlet port 68 downstream from wall openinng 22 and fitted with an inlet conduit 69, see FIG. 3, adapted for connection to a source of sand or other abrasive materials, chemicals and cleaning agents and the like. One use of the device is to leave conduit 69 open to the atmosphere so as to let in air which forms an air blast in conjunction with the water blast increasing the cubic footage of blast volume. A standard blast nozzle 71 is threaded into the forward end 72 of housing 27. Such nozzles are usually formed with a hardened bore 73 designed for use in sand blast equipment and are commercially available from several suppliers. Where the device is designed solely as a water blast, i.e., without the sand blast feature, the front venturi chamber 67 is deleted and the water blast jet issues directly from nozzle 16 through opening 22, see form of invention illustrated in FIG. 6. In the operation of either type of unit, air will be sucked into chamber 24 through drain opening 26 and into surrounding relation to the jet issuing from port 17 for conjoint movement therewith through opening 22 thus expanding the jet size and also clearing chamber 24 of any water or other obstructions which might subsequently impair the shutoff operation of the unit. The opening of the water jet by the air is desirable also in better filling the bore 73 of discharge nozzle 71 thus providing a more prefect displacement of mass out of venturi chamber 67 and a more effective inputting of sand or other material flowing in through the intake port 68.

Figure 6:
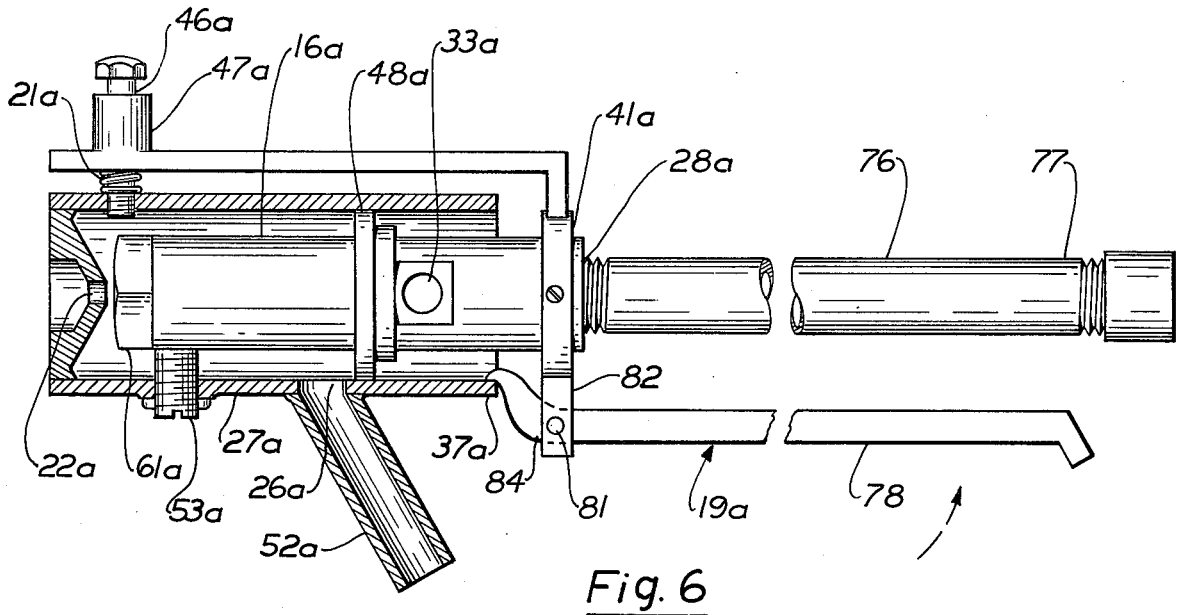
FIG. 6 is a cross-sectional view of a modified form of the device.

A modified form of the invention is illustrated in FIG. 6 of the drawing wherein the forwardly disposed venturi chamber 67 and nozzle 71 are deleted as above explained and the blast jet from nozzle **16*a* is discharged directly through wall opening 22*a* onto the work to be cleaned. Otherwise the housing 27*a* and nozzle 16*a* and its mounting within the housing are identical with the form of the invention illustrated in FIGS. 1–5**.

The principal advantage of this form of the invention is the provision of a rigid extension tube or conduit 76 which is threaded directly into the nozzle intake passage **28*a*** and provides a handle extension or wand for the apparatus enabling the user to extend the reach of the unit so as to position the water discharge jet closer to the work. The wand also makes it possible for the operator to work in confined areas and to greatly increase his effective work area without changing his position.

Another feature of the structure illustrated in FIG. 6 is the extension of the manually engageable means **19*a* longitudinally of the wand 76 for convenient manual operation adjacent the proximate end 77 of wand 76 remote from the jet blast discharge. As here shown, means 19*a* comprises a lever connected to nozzle 16*a* and housing 27*a* and which extends longitudinally in spaced confronting relation to conduit 76 for manual gripping of the lever conjointly with conduit 76. Also and importantly the lever provides mechanical advantage in displacing the nozzle 16*a* into and out of registration with wall opening 22*a* for placing the unit in operating and shutoff position. As here shown, lever 78 is pivoted by pin 81 to an extension 82 of collar 41*a* so as to define a fulcrum for the lever and has an adjacent end 84 formed for engagement with the interior wall surface at the rear end 37*a* of housing 27*a*. The length of the lever between fulcurm 81 and end 84 is much less than the length of the balance of the lever, thus resulting in significant mechanical advantage of the lever in producing the relative swivel action between nozzle 16*a* and housing 27*a* as above discussed. Spring 21*a* and lever 39*a* are retained in identical form in this embodiment for biasing nozzle 16*a* and housing 27*a*** into misaligned, shutoff position. The elimination of the normally heavy water control valve at the blast gun, as required in prior art devices, is particularly significant in making the present device of much lighter weight and providing the attendant advantage of ease of use.

Figure 9:
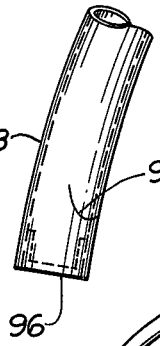
FIG. 9 is a further enlarged fragmentary view of a portion of the apparatus shown in FIG. 8.
Figure 8:
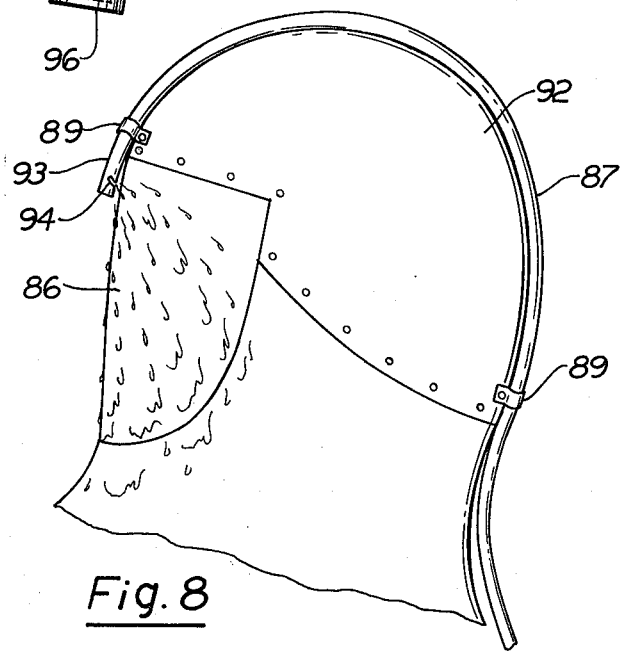
FIG. 8 is a fragmentary enlarged side elevation of a portion of the assembly shown in FIG. 7.
Figure 7:
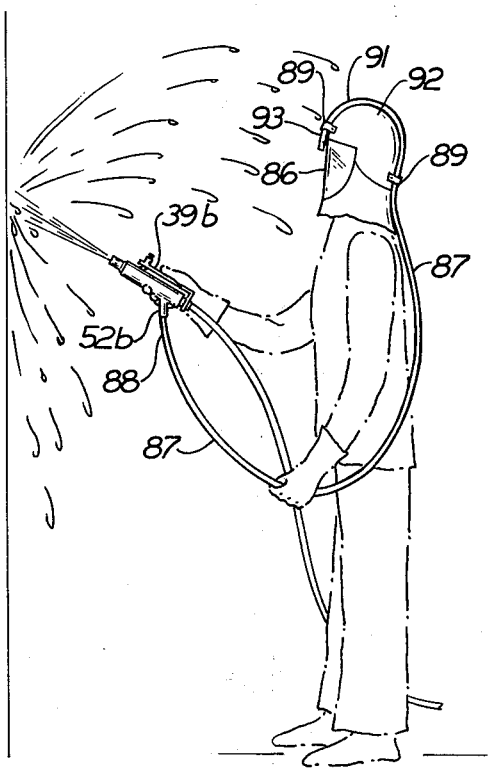
FIG. 7 is a side elevation of the device showing an optional use thereof for cleaning the operator's face shield.

A further modified form of the invention is illustrated in FIGS. 7–9 wherein the water discharged in the shutoff position of the gun is used for cleansing the operator's face shield 86. As here shown a flexible conduit 87 is connected at one end 88 to the discharge pipe **52*b* of the gun and is mounted, as by clips 89, at its other end to the operator's helmet 92 so as to position the distal end 93 of conduit 87 into confronting position with the top of shield 86 for the direction of water over the shield. Any spray means may be provided at the distal end 93. As here shown the normally open end of the conduit is stopped by a closure 96 and a simple slit 94 is formed in the conduit for providing a spray discharge passage. The conduit may be formed of elastomeric material so that slit 94 is self-closing when not in use. The foregoing structure is particularly useful where the operator needs stand close to the work and will accordingly wear protective clothing and a helmet with a clear face shield. Whenever the operator's vision through the shield is impaired by reason of accumulation of debris and the like on the shield, the operator only needs to release his grip on lever 39*b* to cause the device to move automatically into its shutoff position and to direct water through conduit 87 for flushing the front surface of shield 86. Preferably, slit 94** is designed so as to provide a fan-shaped discharge over the face shield with essentially no back pressure in the supply line.

Figure 10:
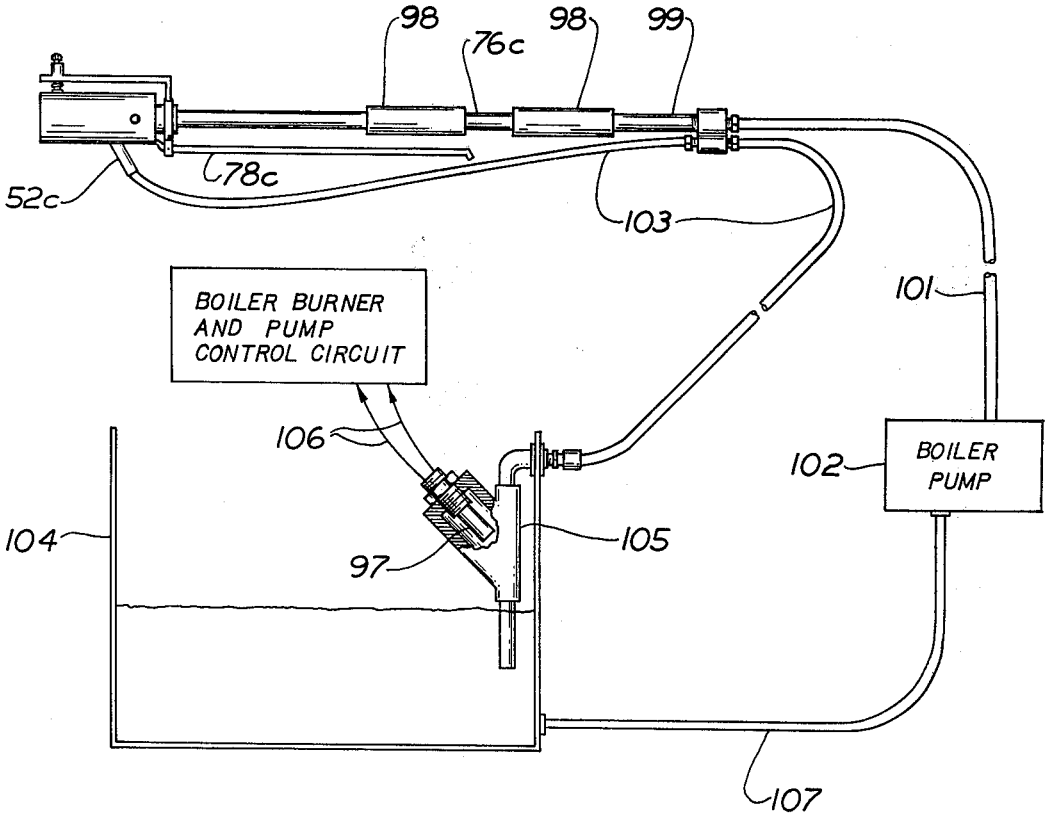
FIG. 10 is a side elevation, partially in section, of a modified form of the invention showing the optional use of the apparatus in controlling the boiler-burner and pump control circuit of a hot water blast system.

A further modified form of the invention is illustrated in FIG. 10 wherein the device is particularly adapted for use in a hot water or steam blast system wherein the fluid source 102 includes a burner for heating the fluid and a pump and a control circuit 108 for the burner and pump. Since such heated fluid is normally harmlessly discharged in the shutoff position of the device, as hereinabove explained, advantage is taken of the fluid discharged for controlling the burner and pump. This is here effected by the association of a thermal sensing means 97 with the discharge outlet 52*c* of the device and connecting such means to control circuit 108. At the same time the fluid discharged may be returned by conduit 107 to the source 102 to conserve water where such conservation is important. The form of the apparatus depicted in FIG. 10 is generally similar to that shown in FIG. 6. A wand extension is particularly desirable in hot water or steam systems so as to protect the operator against splash-back of the hot fluid as well as to afford the operator the convenience and access to interior portions of the equipment being cleaned and not otherwise reachable without a wand. As here shown, the device is threaded onto a rigid conduit extension 76*c* for forming the wand and is provided with insulated grips 98 engageable by the operator conjointly with operating lever 78*c*. The proximal end 99 of conduit 76*c* is connected by high pressure, high temperature hose 101 to the output of the conventional boiler and pump unit 102. Gun discharge 52*c* is similarly connected by a hose 103 to a receiving tank 104 which may be conveniently provided adjacent the boiler-pump unit 102 and may be connected to the water intake side thereof by conduit 107. Thermal sensing means 97 is here mounted in a conduit fitting 105 connecting hose 103 to tank 104 so as to sense the temperature of the water received. Sensing means 97 here comprises a conventional thermostatically operated electric switch, such as manufactured by Fenwal, Incorporated of Ashland, Massachusetts and others, and has switch leads 106 which are connected to the burner and boiler-pump control circuit 108. In prior art high temperature, high pressure closed systems, boiler codes require elaborate control circuits with various interrelated and cofunctioning safety parts. In the main such control systems may be greatly simplified with the device of the present invention since at no time is the high pressure line shut off at the gun. Conventional hot water pressure blast systems usually run at a reduced pressure in the range of 600 to 1,000 psi. At these pressures it is possible to insert a manually operated valve into the line for shutoff purposes. As the pressure increases however the use of such valves becomes infeasible. Also valves used under high temperature and high pressure conditions present operational problems and have a relatively short life. The present return system has no such pressure limitation and will provide a substantially unlimited life even in hot water or steam applications.

Of equal importance, the present always-open discharge and hot-water-return system enables a considerable simplification of the boiler burner and pump control circuit. The return hot water collected in an open tank enables the pump to continue to operate without danger to the system, and similarly the burner can stay on to keep the water heated without danger to the boiler. Preferably the thermal control will be connected to shut off the burner when the water in the receiving tank reaches a predetermined temperature. The pump may be optionally shut off or left running. If the thermal sensing unit shuts off the burners and the pump is left running, the system will ultimately fill with cold water. Thus the control of the boiler-pump supply unit may be effectively controlled by simple laying down of the gun to have it automatically move into its jet shutoff position. The gun may be safely so laid down and left unattended, since even when operated at maximum pressure there is no significant thrust in the reposed position of the gun which may otherwise cause it to whip around on the deck or other surface on which it may be placed.

What is claimed is:

1. A water blast apparatus comprising:

a nozzle adapted for connection to a source of fluid under pressure and having a port for discharging a jet of said fluid;

a wall mounted in spaced relation to said port and providing a fluid diversion passageway therebetween;

said wall and nozzle being mounted for relative displacement into and out of wall intersecting relation to said jet while maintaining said spaced relation, said wall in said jet intersecting relation diverting the fluid in said jet into said passageway, said passageway being formed and dimensioned to provide substantially unimpeded flow of fluid from said port in said wall jet intersecting relation; and manually engageable means connected to said wall and nozzle for effecting said relative displacement.

2. Apparatus as defined in claim 1, said port being formed to issue a jet of predetermined diameter axially of said port, said wall in jet intersecting position traversing said axis for impingement on said wall of said jet and said wall being formed with an opening larger than the diameter of said jet and registrable with said jet axis in one relatively displaced position of said wall and nozzle for substantially unimpeded projection of said jet through said wall.

3. Apparatus as defined in claim 2, said wall being of frusto-conical form having said opening in its apex and being mounted with said wall diverging from said axis in a direction away from said port.

4. Apparatus as defined in claim 3, and means co-functioning with said wall and nozzle for providing a chamber for fluid deflected by said wall in its said jet intersecting position and having a discharge outlet for said chamber.

5. Apparatus as defined in claim 4, said last-named means comprising a housing surrounding said nozzle in spaced relationship to provide said chamber; and a flexible sealing gasket connecting said housing and nozzle and hinging said nozzle for displacement of said jet between positions impinging on said wall and aligned with said wall opening.

6. Apparatus as defined in claim 5, said nozzle having an inlet passage at a first end for connection to said fluid source and having said port at its opposite end;

said gasket being connected to said nozzle intermediate its ends with said first end exteriorly of said gasket with respect to said chamber; and said manually engageable means comprising a lever connected to said first end of said nozzle and having an elongated handle portion extending in spaced substantially parallel relation to the exterior of said housing for joint manual engagement of said handle portion and housing and movement of said handle portion to and from said housing and effecting said relative displacement of said wall and port.

7. Apparatus as defined in claim 6, and means for adjusting the position of said nozzle in said housing in mutually perpendicular directions for obtaining precise alignment of said port and wall opening.

8. Apparatus as defined in claim 4, and operator face shield fluid-cleansing means connected to said discharge outlet.

9. Apparatus as defined in claim 8, said last-named means comprising a conduit connected to said discharge outlet; and spray means connected to said conduit and adapted for mounting on an operator's helmet in position to direct said fluid over said face shield.

10. Apparatus as defined in claim 1, a housing surrounding said nozzle in spaced relationship;

said nozzle being of elongated form and having an inlet passage at one end adapted for connection to said fluid source and having said port at its opposite end;

swivel-motion-mounting means connected to said nozzle intermediate its ends and to said housing;

a length of rigid conduit connected to said nozzle inlet passage and providing a handle extension for said apparatus; and said manually engageable means being positioned for manual engagement and operation adjacent said rigid conduit.

11. Apparatus as defined in claim 10, said manually engageable means comprising a lever connected to said nozzle and housing and extending longitudinally of said rigid conduit in spaced confronting relation thereto for manual gripping of said lever conjointly with said rigid conduit.

12. Apparatus as defined in claim 4, wherein said fluid source includes a burner for heating said fluid and a pump and a control circuit for said burner and pump; and thermal-sensing means connected to said outlet and adapted for connection to said control circuit.

13. Apparatus as defined in claim 12, and a conduit connected to said outlet and adapted to return fluid to said source.

* * * * *

UNITED STATES PATENT OFFICE

CERTIFICATE OF CORRECTION

PATENT NO. : 3,930,616

DATED : January 6, 1976

INVENTOR(S) : Frank N. Winter

It is certified that error appears in the above-identified patent and that said Letters Patent are hereby corrected as shown below:

Abstract, line 22, change "confunctioning" to ---cofunctioning---;

Column 5, line 24, after "to" insert ---be---;

Column 5, line 27, change "openinng" to ---opening---.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*